United States Patent [19]

Webb

[11] 3,999,334

[45] Dec. 28, 1976

[54] WEBB BASEMENT WINDOW ESCAPE

[76] Inventor: Frank L. Webb, 2127 Austinburg Road, Ashtabula, Ohio 44004

[22] Filed: Dec. 15, 1975

[21] Appl. No.: 640,883

[52] U.S. Cl. ..... 52/20; 52/107; 52/183; 52/184; 182/86; 182/97

[51] Int. Cl.[2] ..... E04F 17/06

[58] Field of Search ..... 52/19, 20, 107, 183, 52/184, 182; 182/82, 93, 95, 86, 97

[56] References Cited

UNITED STATES PATENTS

| | | | |
|---|---|---|---|
| 2,086,247 | 7/1937 | Thesen | 52/107 |
| 2,274,451 | 2/1942 | Kyle | 52/20 |
| 2,695,689 | 11/1954 | Peterson | 52/107 |
| 3,046,613 | 7/1962 | Smith | 52/107 |
| 3,128,508 | 4/1964 | Burnham | 52/107 |
| 3,608,252 | 9/1971 | Bisson | 52/19 |
| 3,703,791 | 11/1972 | Slade | 52/107 |
| 3,792,558 | 1/1974 | Berce | 52/143 |
| 3,848,378 | 11/1974 | Witte | 52/184 |

*Primary Examiner*—Price C. Faw, Jr.
*Assistant Examiner*—Henry Raduazo
*Attorney, Agent, or Firm*—Baldwin, Egan, Walling & Fetzer

[57] ABSTRACT

This device consists primarily of a molded plastic structure having flange mounting means for mounting the structure to the basement wall. The device includes a window portion on a vertical plane adjacent to a hinged top bubble which enables more light to be admitted into the basement and serves as a quick escape means from a basement in the event of fire or a severe storm, and the interior of the structure includes step means molded therein for the user to easily climb out through the pivotable bubble top thereof.

2 Claims, 3 Drawing Figures

Fig. 1
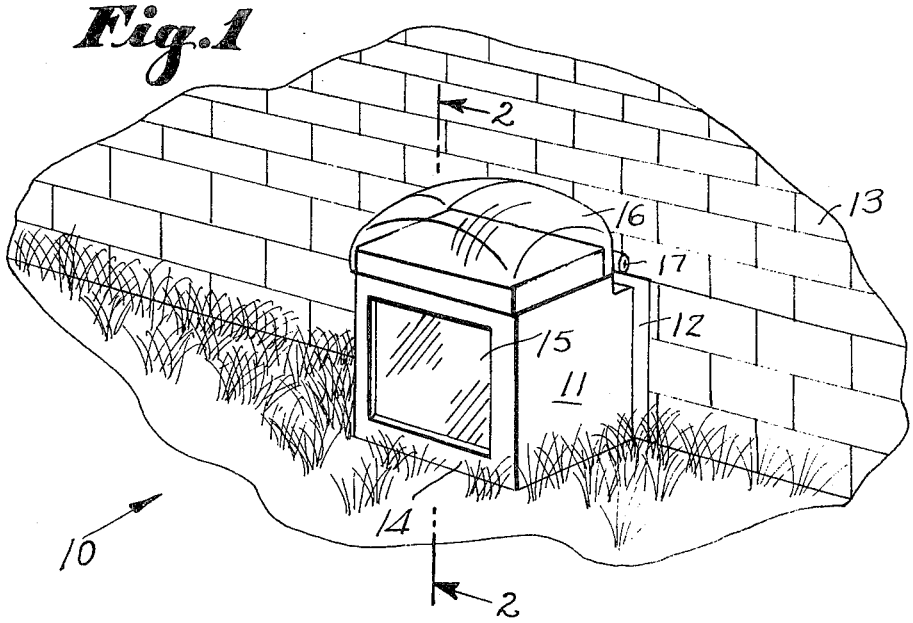
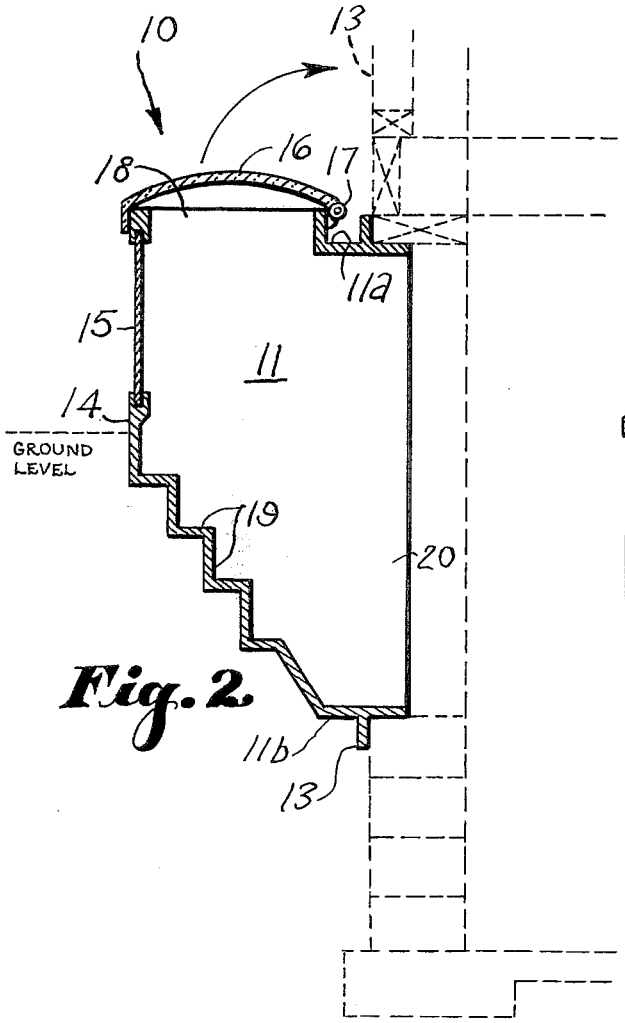
Fig. 2
Fig. 3
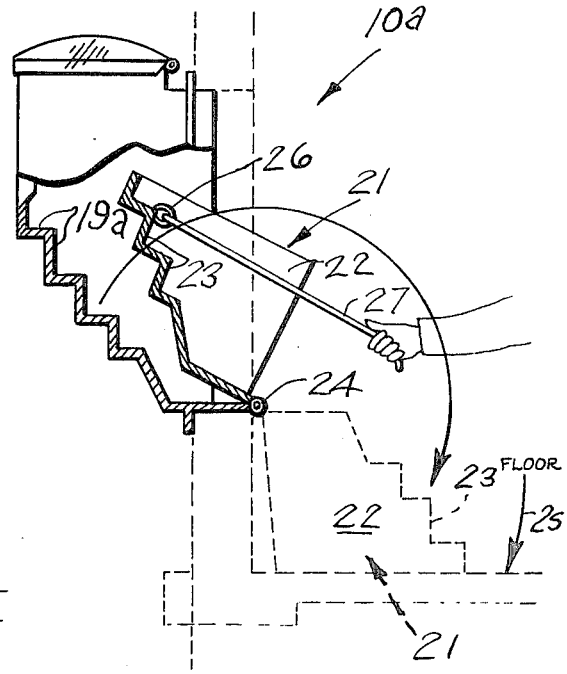

WEBB BASEMENT WINDOW ESCAPE

This invention relates to basement windows, and more particularly to a basement escape window structure.

It is therefore the principal object of this invention to provide a basement escape window structure which will enable young and old, to easily escape from basements that become fire traps when stairways are cut off by fire or storm.

Another object of this invention is to provide a structure of the type described, which will be a one piece molded or cast plastic unit which will have a hinged bubble and waterproof top which will serve as escape hatch means for the occupants of the basement.

A further object of this invention is to provide a structure of the type described, which will have a vertical window adjacent to the bubble top and on the interior of the structure, will be a plurality of steps for easily ascending in order to escape from the opening having a hinged bubble top thereon.

Other objects of the invention are to provide a basement escape window structure, which is simple in design, inexpensive to manufacture, rugged in construction, easy to use and efficient in use.

These and other objects will be readily evident upon a study of the following specification and the accompanying drawing, wherein:

FIG. 1 is a perspective view of the present invention;

FIG. 2 is a cross sectional view taken along the line 2—2 of FIG. 1;

FIG. 3 is similar to FIG. 2, but shows a modified form of structure, which includes a auxiliary stairway which will normally abut with the step portions of the main embodiment, but in the event of a fire, may be pulled pivotably downward upon the basement floor so as to enable the elderly or small children to easily climb upwards and out of the pivotable bubble top.

According to this invention, an escape basement window structure 10 is shown to include parallel spaced apart side walls 11, a stop wall 11*a* and a bottom wall 11*b* from which extends a flange 12 which will be suitably anchored to basement wall 13. The front wall 14 includes a window 15.

It shall be noted that the entire structure 10 is of molded or cast plastic material with the exception of the transparent bubble top 16 which is waterproof and hinged by hinge 17 means over the opening 18. On the interior of structure 10 below window 15, are a plurality of steps 19 molded therein for easy ascending to escape from the opening 18 after entering the opening 20 from the basement.

In use, after the user ascends steps 19, the bubble top 16 is easily lifted pivotably upwards.

It shall also be noted, that structure 10 will provide more light for the basement area than window structures of the prior art.

Referring now to FIG. 3 of the drawing, a similar structure 10*a* is shown to have internal steps 19*a* which will mate with a pivotable step structure 21 having parallel spaced apart side wall 22 molded integral with a plurality of steps 23. Structure 21 is hinged by hinge 24 means to the lower portion of structure 10*a* and when not in use, steps 23 of structure 21 matingly engage with step 19*a*. When structure 22 is pivoted inwards of the basement, it will rest upon floor 25 which is indicated by the arrow. A ring 26 is fixedly secured to the interior step 23 portion of structure 21 and ring 26 pivotably receives rod 27 which serves as handle grip means for pivoting structure 21 inwards of the basement.

What I now claim is:

1. An integral basement escape window structure adapted to extend upwardly from an opening in a basement wall and outwardly of said wall above ground level, comprising parallel spaced apart side walls, a front wall, a bottom wall, a top wall having an escape opening, a window and external flange means molded in said structure, a waterproof top normally closing said escape opening and adapted to be opened by a push from below, said structure being generally open between said walls on the basement side, and means molded in said structure for ascending from the basement to said escape opening on the outside of the building structure in which said window structure is installed, wherein said flange means of said structure extends outwards from said side walls, said top wall, and said bottom wall, and said flange means is positioned to be secured fixedly to the wall of the said building structure, wherein said flange means is spaced apart from the opening of said structure inserted within said basement, and said means for ascending the interior of said structure comprises a plurality of steps molded therein, said steps extending from said bottom wall to the front wall in which a window is secured, said window being vertical and below said top.

2. The combination according to claim 1, wherein said top is hingeably secured to the top wall of said structure and which in closed position is on a horizontal plane.

* * * * *